United States Patent [19]

Larsen

[11] 3,991,842

[45] Nov. 16, 1976

[54] MOVABLE VACUUM SECURED APPARATUS FOR INCLINED OR VERTICAL SURFACES

[75] Inventor: Lyle Vernon Larsen, Naperville, Ill.

[73] Assignee: Chicago Bridge & Iron Company, Oak Brook, Ill.

[22] Filed: July 25, 1975

[21] Appl. No.: 599,160

[52] U.S. Cl. ..... 180/1 VS; 180/115; 425/64; 425/817 C

[51] Int. Cl.[2] ..... B62D 63/02

[58] Field of Search ..... 180/1 VS, 115; 305/9; 264/33, 34, 35, 45.4, 45.8, 46.5, 46.9; 425/4 C, 817 C, 63, 64, 65, 447, 449, 470, DIG. 14, 115, 113; 118/108, 207, 305

[56] References Cited

UNITED STATES PATENTS

| | | | |
|---|---|---|---|
| 3,170,532 | 2/1965 | Boppart, Jr. | 180/115 X |
| 3,548,453 | 12/1970 | Garis | 425/4 C |
| 3,810,515 | 5/1974 | Ingro | 180/1 VS |
| 3,926,277 | 12/1975 | Shino et al. | 180/115 |

*Primary Examiner*—Richard B. Lazarus
*Assistant Examiner*—Mark Rosenbaum
*Attorney, Agent, or Firm*—Merriam, Marshall, Shapiro & Klose

[57] ABSTRACT

Apparatus, to be movably and releasably secured to an inclined or vertical surface, having a rigid framework having two pairs of axially mounted vertically spaced-apart horizontal wheels horizontally spaced-apart on a framework, an endless track mounted on the wheels having linked track members, with each member having a cavity adapted to press against said surface and be secured thereto by a vacuum in the cavity, an open space within the framework and wheels, a flexible conduit extending from the cavity of each track member into the framework open space and to a vacuum valving means for selectively creating and maintaining a vacuum between the track member and the surface when in contact therewith, and means to drive the wheels to thereby effect crawling of the track as it is held by vacuum on the surface.

19 Claims, 16 Drawing Figures

MOVABLE VACUUM SECURED APPARATUS FOR INCLINED OR VERTICAL SURFACES

This invention relates to apparatus which can travel along a surface. More particularly, this invention provides apparatus which can be movably and releasably secured to an inclined or vertical surface for supporting other apparatus or equipment for performing work on or near the surface.

In the erection or construction of large reactors, storage tanks and other structures having large inclined or vertical surfaces, it is often necessary that work be performed either on the surfaces of such structures or on elements related thereto. It is quite often necessary, or at least very generally desirable, that suitable equipment be fastened or joined to the surfaces so sufficient force can be applied to, or along, the surface to perform the work.

A conventional way of supporting a work platform for equipment on an inclined or vertical surface is by means of cables or other lines joined to a supporting structure located above the area to be worked on. Such platforms have been previously adapted for vertical movement as well as horizontal movement and they perform many useful purposes in the construction industry. Such supporting systems, however, are not useful where it is important that a significant force be applied along or toward the working surface to regulate some activity connected with the work being performed on the surface. For example, in the insulation of large low temperature tanks one common method is to deposit a layer of polyurethane foam between the tank wall and an outer metal covering so that the resulting cured insulating foam is protected from physical damage and sealed against the entry of moisture. The deposition of this foamed-in-place insulation inherently produces an outwardly directed force due to the expansion of the foam. It is necessary to oppose this outwardly directed force to adequately control the thickness of the insulating layer and to assure adhesion of the metal covering to the insulation. It is also desirable to maintain a tension in the outer metal covering as it is applied. Thus, a means is needed which will provide the necessary lateral force for this purpose.

Garis U.S. Pat. No. 3,548,453 discloses apparatus for applying foamed-in-place insulation on vertical surfaces of large tanks. The apparatus is supported by cables and the insulation is applied in a vertical direction in strips or it is applied horizontally in the shape of rings around the tank. The system shown in the Garis patent in practice relies principally upon the inward component of tensioned bracing cables to provide the force required to oppose the outward pressure which is exerted by the expansion of the foam as it is deposited in place. Goff U.S. Pat. No. 3,863,393 also discloses apparatus for pressing a working platform or rig against a vertical surface, such as a tank wall, by the use of a series of cables. However, experience has shown that with this general method it is most difficult, if not impossible, to maintain the sought for uniform force when the working platform or rig is displaced vertically or horizontally in use.

There are a number of devices disclosed in the prior art which could be employed to obtain a releasable movable grip or to hold on to an upwardly extending surface. For example, Ingro U.S. Pat. No. 3,810,515 discloses a vertical wall climbing device which is based on magnets. Allen U.S. Pat. No. 2,030,840 discloses a magnetic device for climbing the vertical surfaces of metallic smoke stacks for the painting thereof by remote control. Magnetic gripping devices do not lend themselves to use on nonmetallic surfaces so that their utilization is accordingly limited. Furthermore, for large devices the weight and power requirements of a magnetic movable gripping device become excessive.

German published patent application No. 2,032,231 discloses a device for climbing vertical surfaces. The device utilizes endless tracks which can employ either magnets or suction cups on the treads to obtain the securing force. Although the disclosure indicates that a positive vacuum can be created by use of conduits there is no specific disclosure of how this could be effected. Also, experience indicates that such a device will perform very poorly with suction cups unless undisclosed essential elements are added to provide a positive seating force to each successive suction cup as it contacts the surface as the device progresses along the surface.

Boppart U.S. Pat. No. 3,170,532 discloses a traction vehicle which employs a pair of endless tracks made of linked-together plates. To supplement the frictional force exerted by the tracks on the horizontal bearing surface, cavities are provided in the track plates and a reduced pressure is created therein to develop a further gripping action on the surface. The sub-atmospheric pressure is created by use of a fan in communication with a plenum chamber for evacuation of air from cavities in the track plates. The plenum type of arrangement for valving the cavities in the track plates would inherently be difficult to manufacture and use without substantial leakage. This leakage can be tolerated with the particular vehicle and use described but a much higher degree of vacuum and, therefore, leak tightness must be maintained to obtain the gripping forces required for an apparatus operating on an inclined or vertical surface.

From the above, it is clear that an additional need exists for an apparatus which is movable releasably about an inclined or vertical surface, yet which forceably and securely attaches to the surface by means of a vacuum.

According to the present invention there is provided an apparatus which is movably and releasably secured to an inclined or vertical surface by vacuum which includes as a part thereof a rigid framework having pairs of vertically spaced-apart horizontal wheels mounted axially to each other and horizontally spaced apart on a support framework. An endless track is mounted on the wheels and comprises a plurality of pivotally-linked together track members, with each track member having a rim about a cavity and being adapted to press against an inclined or vertical surface and to be secured thereto when a vacuum is created in the cavity. The space between the vertically spaced-apart pairs of wheels is sufficiently open to accommodate flexible conduits which provide communication between the cavity of each track member and vacuum valving means as the track member makes its traverse. The vacuum valving means is so constructed as to selectively create and maintain a vacuum between each track member when in contact with an inclined or vertical surface. A means to drive the wheels to thereby effect crawling of the track as it is secured by vacuum on an inclined or vertical surface is also included in the apparatus. The track is driven around the wheels when the apparatus is not engaged with a surface and the drive is turned on but, when engaged on a surface, the wheels roll along on the track with the track members on the surface remaining stationary.

The wheels supporting the track are advisably sprockets with teeth which engage pin-like means provided on the endless track linkage so that positive movement of the track around the sprockets is effected.

The vacuum valving means can be a rotatable horizontal plate with ports to which the ends of the flexible conduits are joined. The horizontal plate is synchronized by suitable means so that it will rotate one revolution per revolution of the track. Means are provided to selectively draw a vacuum in one or more of the ports in the plates to thereby create a vacuum in the cavity of one or more of the track members by means of the conduits communicating with the ports and with the track members. The valving means is so adapted as to maintain a vacuum in the cavity of consecutive track members when they are in contact with a vertical or inclined surface.

The vacuum valving means is one which preferentially will generally effect three functions. One function is to selectively and separately pull a vacuum in the cavity of a lead or first track member as it is pushed against a surface. This effectively seats the track member upon the surface and draws a vacuum in the cavity, before being placed in communication with a vacuum source which is engaged at the same time in maintaining a vacuum in the cavities of a series of track members already held against the surface by means of vacuum. A second function of the preferred valving means is to maintain an unimpaired vacuum in the cavities of a consecutive series of track members so that a length of the endless track can be maintained securely on a surface by means of the vacuum force; experience has shown this to be important. A third function of the preferred valving means is to provide for release of the vacuum in the cavity of the terminal track member before it is removed from contact with the surface. The vacuum is desirably released in the cavity of such a terminal track member before it comes out of such contact so it need not be forceably pulled away from the surface.

Because the apparatus is intended for use on surfaces which can be uneven, such as the surface of storage tanks, it is beneficial to provide for outward movement or displacement of each of the track members as it is moved into contacting position with a surface and to then create a vacuum in the cavity of the track member. The displacement of the track member into forced contact with the surface creates an initial seal about the rim of the track member and thereby permits a more rapid and efficient evacuation of the cavity to create the vacuum sought.

The holding force developed by the evacuated cavities of the track members is transmitted to the supporting framework by means of a guide member on the framework which can bear against and be restrained by a sliding or rolling restraining member attached to each of the track members. The guide member may be straight or curved to generally conform with the surface on which the apparatus is to operate and the restraining members may be resiliently mounted to the track members to accommodate surface irregularities and other departures from the contour of the guide member. Specifically, the guide member can be a channel and the restraining member, on each track member, can comprise a roller on the lower end of a vertical axle which is pivotally joined to a support on the upper part of the track member. The roller rides in the guide rail channel. A resilient means, such as compression springs, is provided to secure a lower portion of the axle to the back of the track member so that limited inward or outward displacement of the track member relative to the roller and the guide member can be effected. This lateral movement permits accommodation of the track to irregular surfaces and curvilinear surfaces.

Apparatus as described can be used to secure a working platform firmly to an inclined or vertical surface, it being understood that the weight of the apparatus is generally to be borne by other support means, such as cables. The primary purpose of the vacuum track is to permit securement of the framework relative to the surface so that lateral positioning remains stable and a significant, inward resisting force can be applied.

The apparatus is especially useful as a support for foaming-in-place equipment for insulating tank walls. It can be used for other purposes such as for supporting equipment for mechanically abrading metal or concrete surfaces preparatory to painting or coating the surface.

The invention will be described further in conjunction with the attached drawings in which.

So far as is practical the same parts or elements which appear in the different figures of the drawings will be identified by the same numbers.

Figure 1:
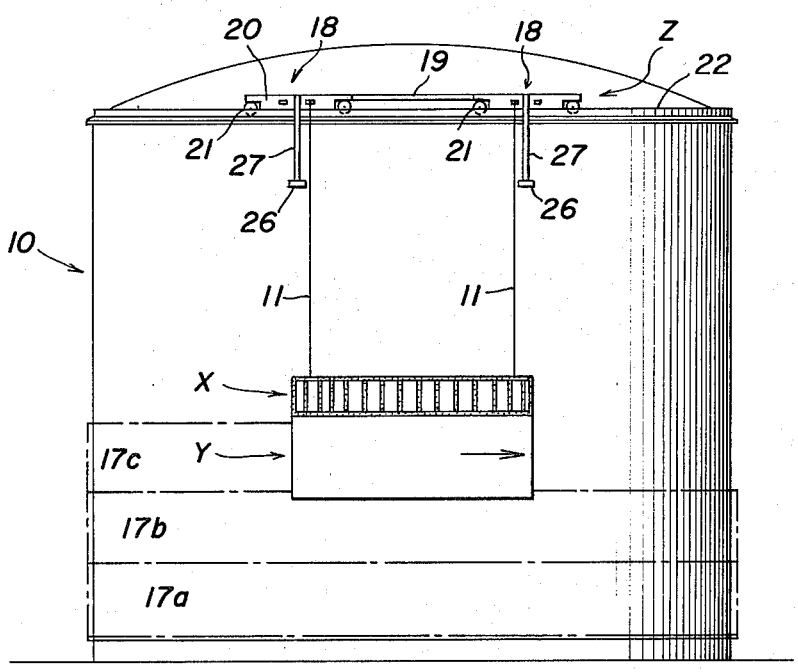
FIG. 1 is an elevational view of a cylindrical storage tank on which the vacuum securing apparatus of this invention is mounted and which is suspended from a top carriage on the tank roof and which has a working platform mounted beneath it.

With reference to FIG. 1 the cylindrical tank 10 has a vacuum securing apparatus X mounted thereto. Working platform Y is mounted beneath the vacuum securing apparatus X. Top carriage Z is mounted on the top of tank 10. Cables 11 extend from winches 12 mounted on the bottom 172 of working platform Y and extend through a pair of sheaves 13 upwardly to cable attachments 14 mounted on the tubular support frame 15 of top carriage Z. The pair of sheaves 13 are movable simultaneously laterally so that positioning of the cables 11 with respect to the vacuum securing apparatus X and the working carriage Y can be adjusted to alter the rotating gravitational moments which urge the working platform Y against the tank surface.

Vertical movement of the vacuum securing apparatus X and the working platform Y is effected by the winches 12 through a control panel (not shown) mounted on the working platform Y where an operator is located. The storage tank 10 as shown in FIG. 1 has two horizontal courses of polyurethane insulating foam 16 deposited in place and covered by horizontal courses of metal sheeting 17*a* and 17*b* with the third course of metal sheeting 17*c* being deposited over a third course of insulating foam being deposited in place by the apparatus herein described.

Figure 2:
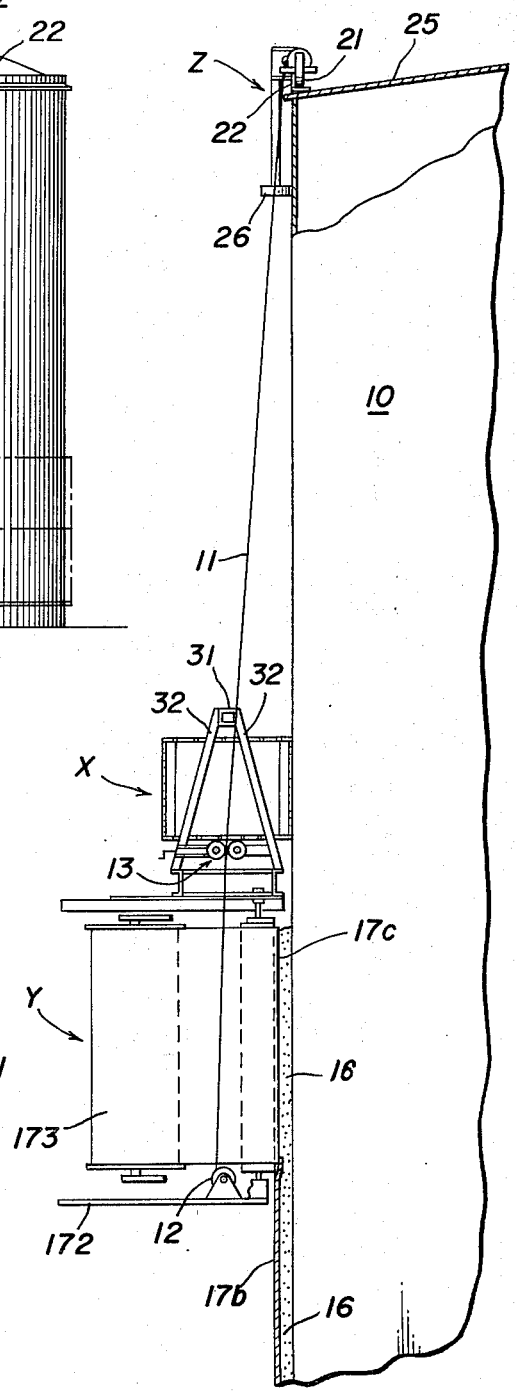
FIG. 2 is a side elevation, partically broken away, of the apparatus of FIG. 1.
Figure 3:
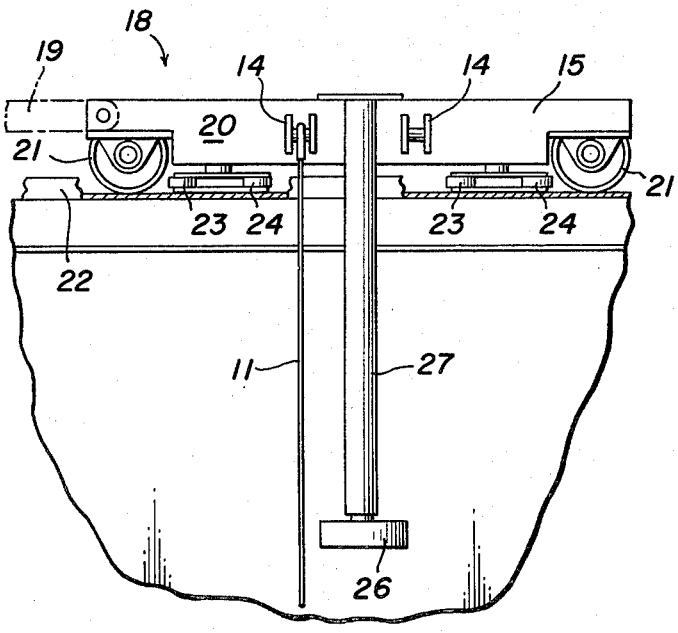
FIG. 3 is a partially broken away front elevational view of the top carriage supporting the vacuum securing apparatus.

As shown in FIGS. 1 to 3, the top carriage Z has two supporting units 18 joined together by a connector member 19. One of the units 18 provided with a suitable drive means (not shown) for moving the top carriage Z at the same speed as the vacuum securing apparatus X. Each unit 18 has a horizontal tubular support frame 15 with a supporting wheel 21 mounted at each end thereof. The support wheels 21 ride on the horizontal flange of angle 22 which is removably positioned around the peripheral edge of the roof 25 of tank 10. Two pairs of lateral thrust wheels 23 and 24 ride against the vertical flange of angle 22. The top carriage Z is stabilized against tilting by means of a wheel 26 rotatably mounted at the end of pipe 27 which extends downwardly from the frame 15. Wheel 26 contacts and rotates against the surface of tank 10.

Figure 4:
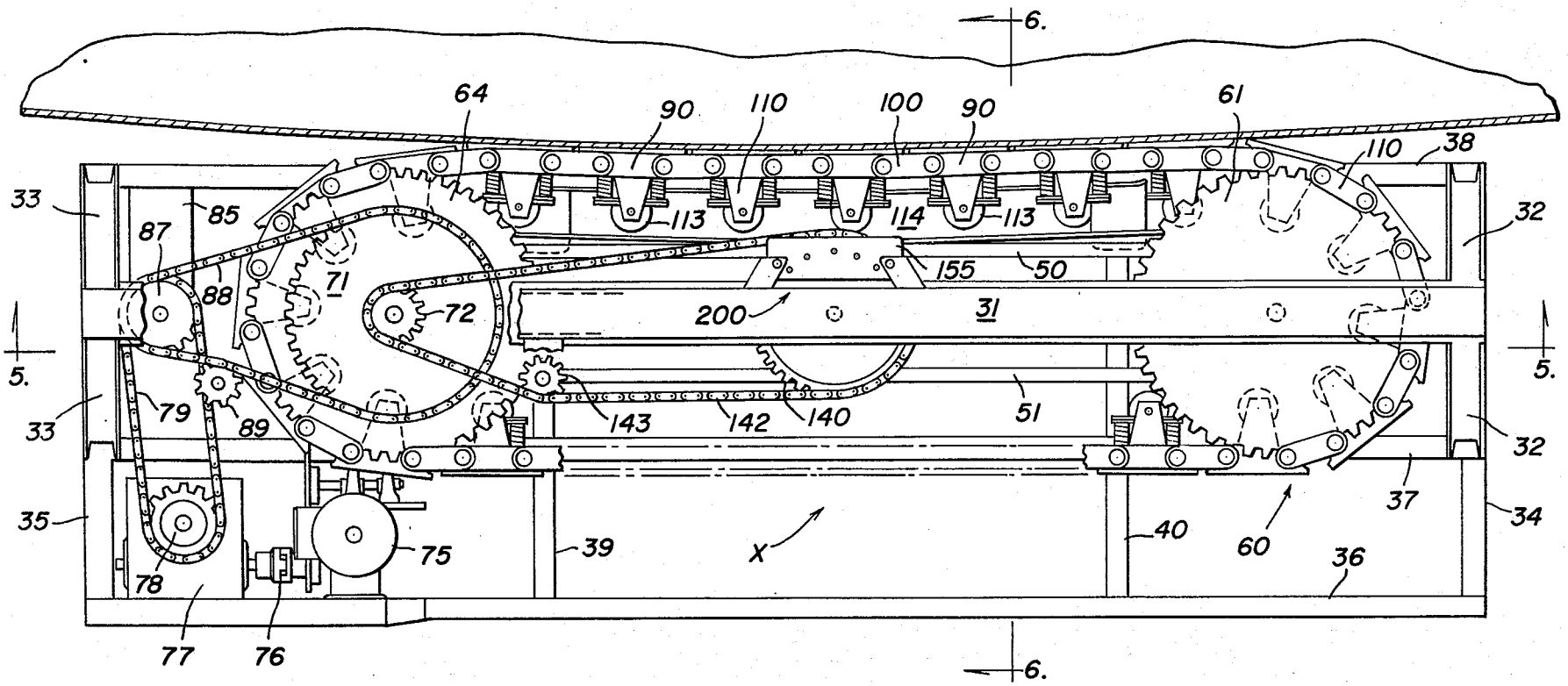
FIG. 4 is a plan view of the vacuum securing apparatus.
Figure 5:
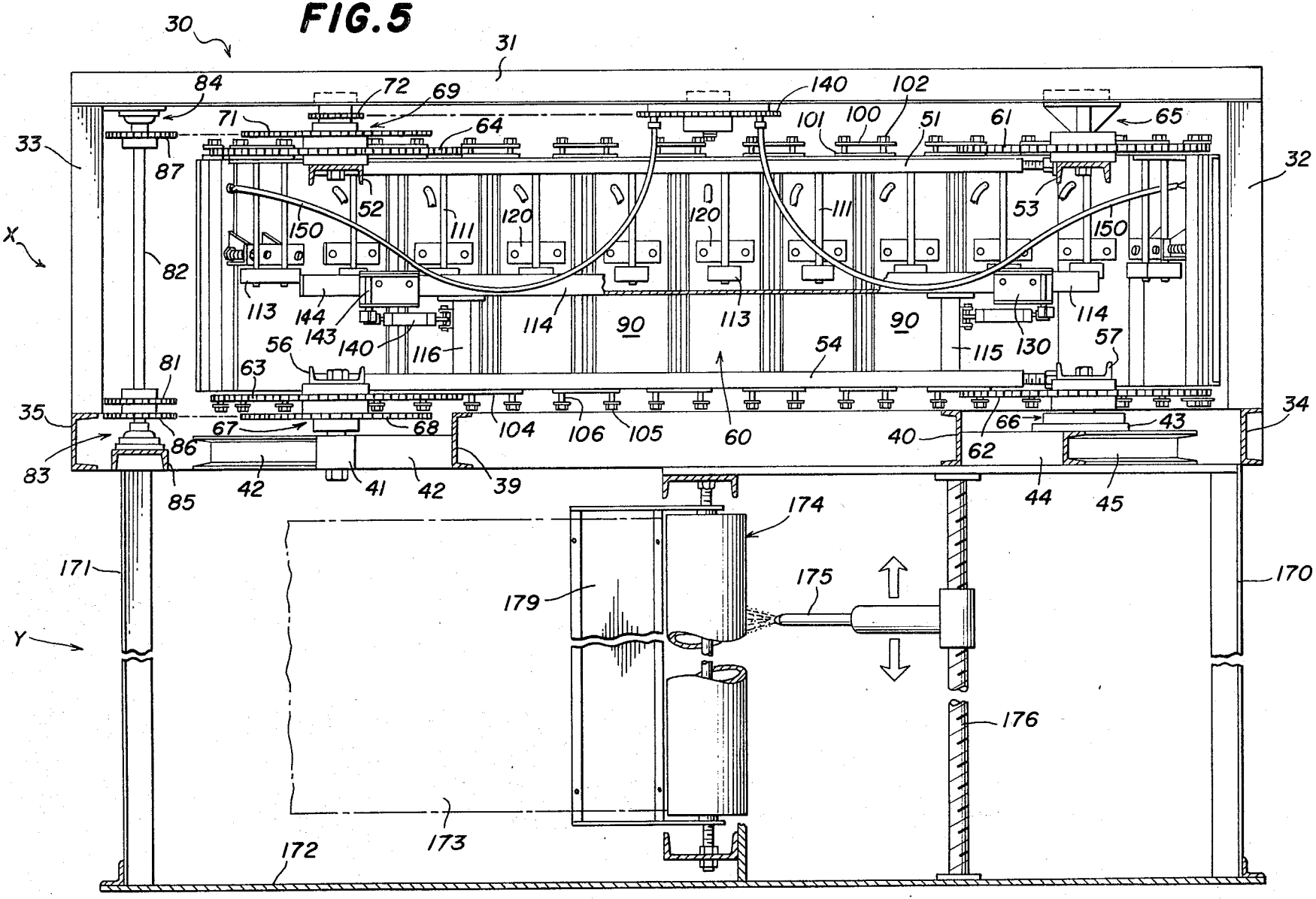
FIG. 5 is a vertical sectional view taken along the line 5—5 of FIG. 4.
Figure 6:
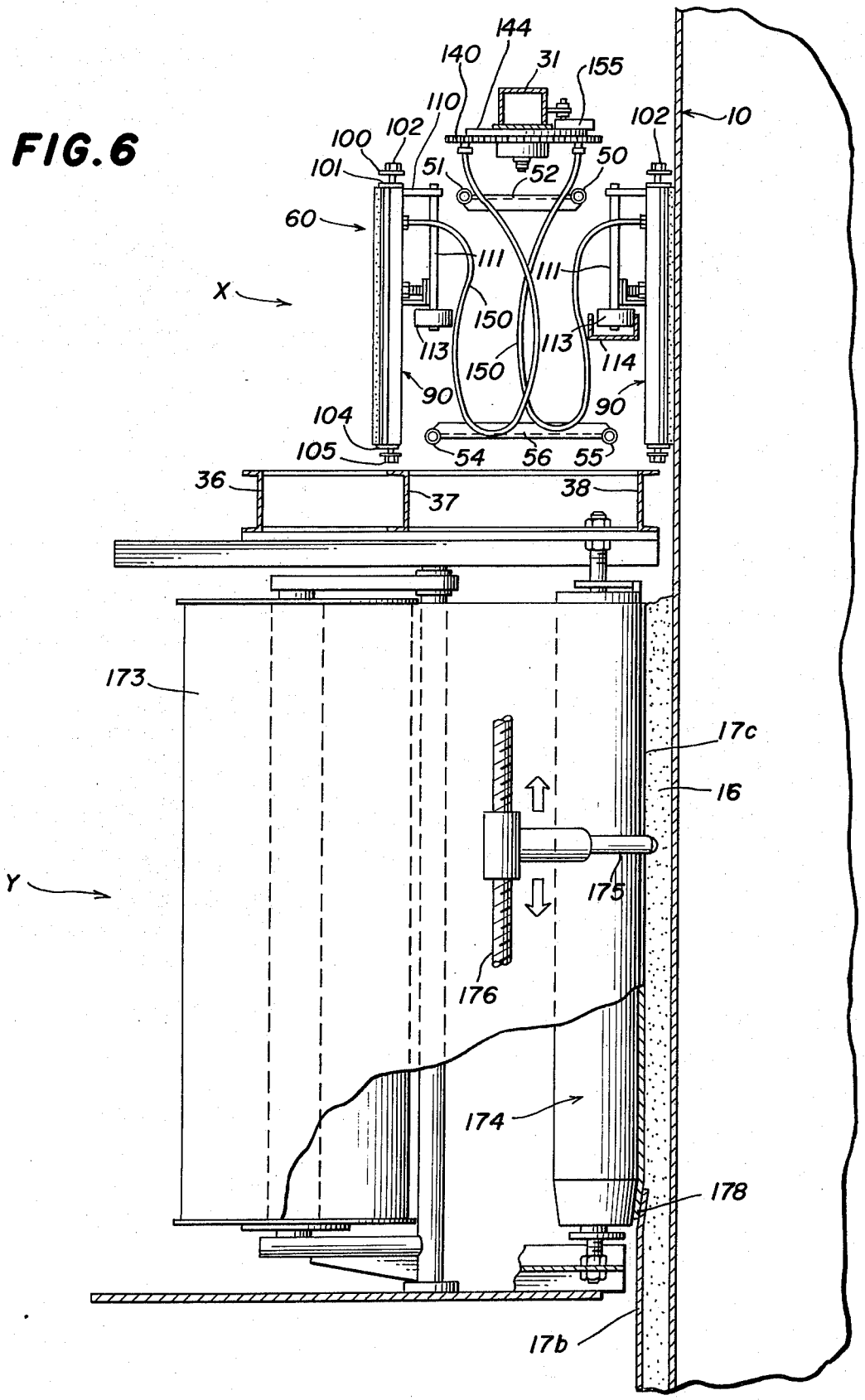
FIG. 6 is a vertical sectional view taken along the line 6—6 of the apparatus shown in FIG. 4.
Figure 7:
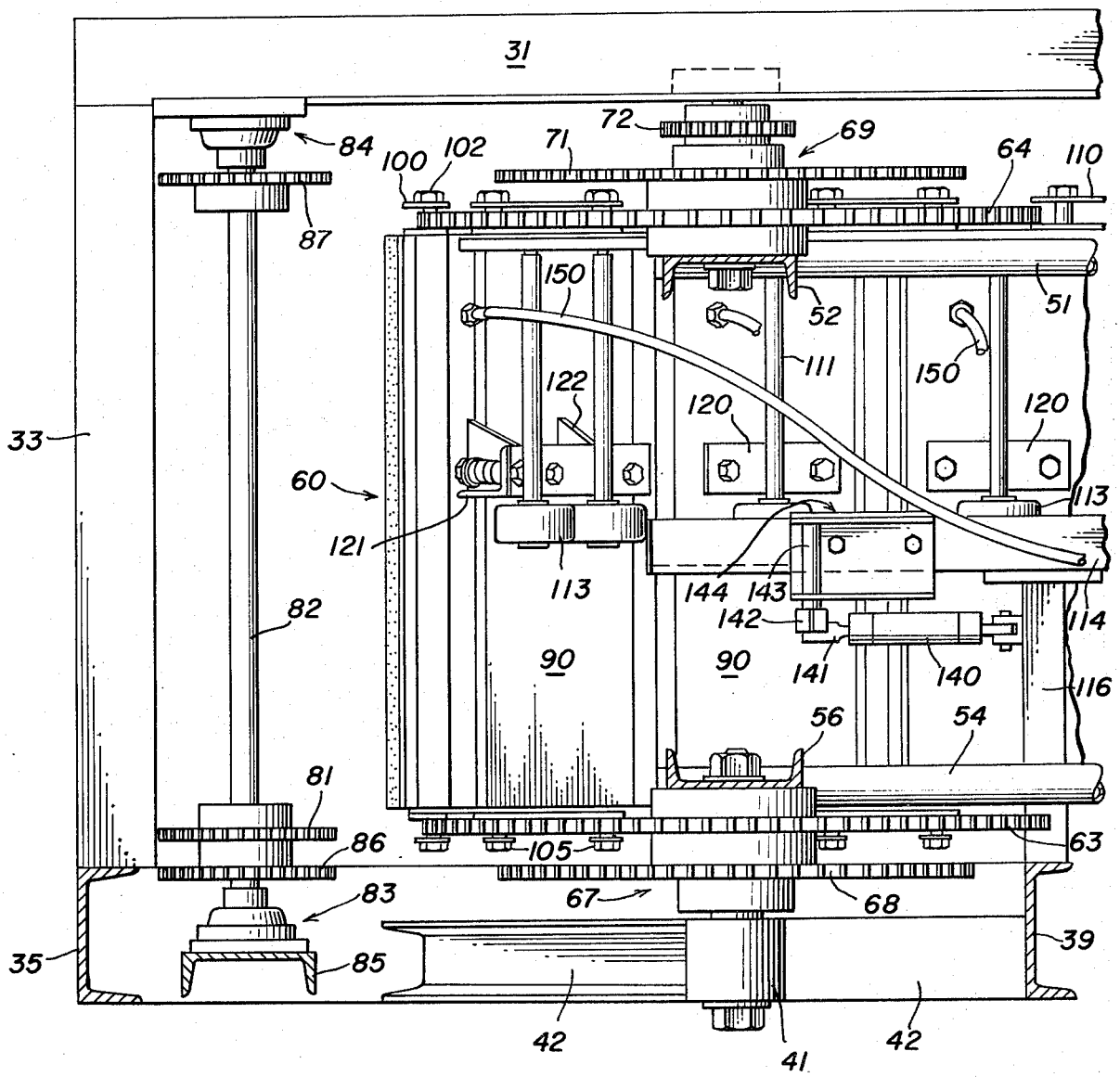
FIG. 7 is an enlarged view of the vacuum securing apparatus shown in the left one-third of FIG. 5.
Figure 8:
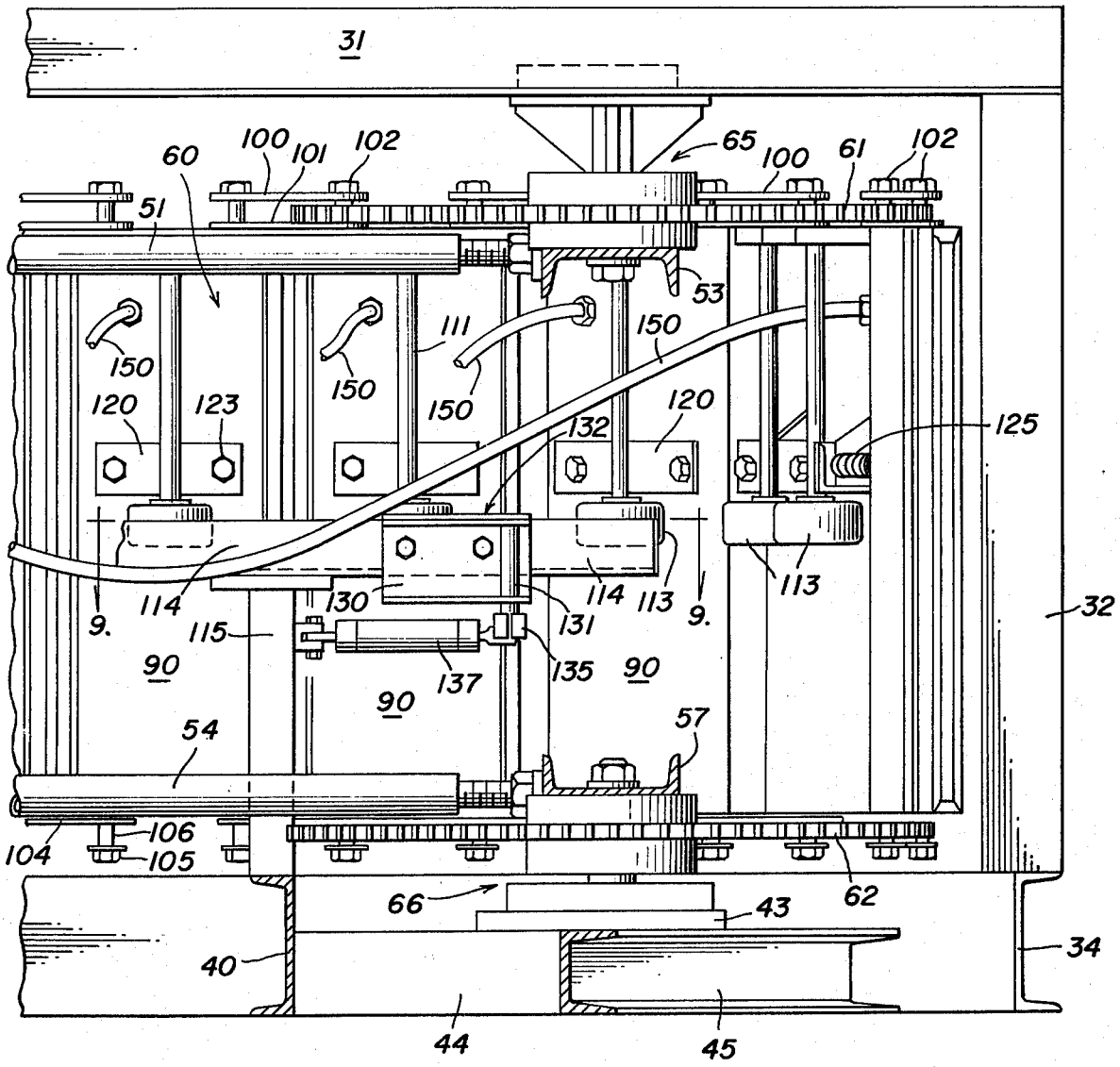
FIG. 8 is an enlarged view of the right one-third of the vacuum securing apparatus shown in FIG. 5.

The vacuum securing apparatus X has a rigid framework 30 (FIGS. 4 to 8). The rigid framework 30 has a horizontal centrally located beam 31 which is supported at its ends by two pairs of legs 32 and 33 (FIGS. 4, 7 and 8). The pair of legs 32 are positioned like an A-frame with the lower ends of the legs resting on horizontal beam 34. Similarly, the pair of legs 33 are also positioned like an A-frame and the lower ends thereof are joined to horizontal beam 35. Three longitudinal beams 36, 37 and 38 are joined at their ends to horizontal beams 34 and 35. Lateral beams 39 and 40 extend from beam 36 to beam 38 and stiffen the framework.

Axle bearing block 41 is supported by four short channels 42 mounted in the shape of an X and joined at their outer ends to longitudinal beams 37 and 38 (FIGS. 5 and 7). In a similar manner, support plate 43 is mounted on a pair of horizontally positioned channels 44 and 45 mounted in an X shape and extending between longitudinal beams 37 and 38 (FIGS. 5 and 8).

A top pair of adjusting rods 50 and 51 are joined at their ends to channel members 52 and 53 (FIGS. 4 to 8). In a similar manner a pair of lower adjusting rods 54 and 55 are joined at their ends to channel members 56 and 57. The channel members 52 and 56 are fixed in place while the channel members 53 and 57 are slidable and adjustable by means of a screw arrangement possessed by each of the adjusting rods 50, 51, 54, and 55. Each of the channel members 53 and 57 provides support for sprockets which support the endless track 60 as will be more fully explained hereinafter.

The endless track 60 is mounted on two pair of vertically spaced-apart horizontal wheels 61, 62, 63 and 64. As shown in the drawings these wheels constitute sprockets. The pair of sprockets 61 and 62 is mounted axially to each other. Similarly, the sprockets 63 and 64 are also mounted axially to each other. The pair of sprockets 61 and 62 is horizontally spaced apart from the pair of sprockets 63 and 64.

Each of the sprockets is mounted on the rigid framework 30 by a suitable supporting framework. Sprocket 61 (FIGS. 5 and 8) is supported beneath horizontal beam 31 by means of a framework 65. Suitable bearing means is included so the sprocket 61 will rotate freely. In a similar manner the sprocket 62 (FIGS. 5 and 8) is supported by a framework 66, including suitable bearing means, on support plate 43. The sprockets 61 and 62 are movable by means of the adjusting rods 50, 51, 54 and 55 to increase or decrease tension on the endless track 60 supported and driven by the sprockets.

Sprocket 63 is supported by a framework 67, which includes suitable bearing means, on the beam supports 42 and the axle bearing block 41 (FIGS. 5 and 7). The supporting framework 67 also supports sprocket 68 which is mounted on the same shaft on which the sprocket 63 is mounted. Sprockets 63 and 68 rotate in unison.

A framework 69 supports sprocket 64 in position beneath horizontal beam 31 (FIGS. 5 and 7). The framework 69 also supports a sprocket 71 and a sprocket 72. All of sprockets 64, 71 and 72 are mounted on the same vertical shaft and rotate together at the same speed.

Motor 75 (FIG. 4) by suitable gearing communicates with clutch 76 which engages a drive shaft communicating with gear reducer box 77. Sprocket 78 is mounted on a shaft extending from the gear reducer box 77. Drive chain 79 extends from sprocket 78 to sprocket 81 (FIGS. 4 and 5). Sprocket 81 is mounted on vertical axle 82. The axle 82 is supported at each end by suitable supporting framework, including bearing means, 83 and 84. The lower framework 83 rests on beam 85 which extends between beams 37 and 38. The upper supporting framework 84 is mounted beneath longitudinal beam 31. Sprocket 86 is also mounted on shaft 82 but below sprocket 81. A chain (not shown) extends around sprockets 86 and 68. In a similar manner sprocket 87 is mounted near the top of shaft 82 and chain 88 (FIG. 4) extends around sprockets 87 and 71 with tension being maintained on the chain 88 by idler sprocket 89.

Sprockets 81, 86 and 87 are of the same size. Sprockets 68 and 71 are also of the same size. Therefore, the chain drives from sprockets 86 and 87 rotate the sprockets 68 and 71 at the same speed even though sprockets 68 and 71 are not mounted on the same shaft or axle. Furthermore, for each revolution of the sprockets 68 and 71 the sprockets 63 and 64, which are of the same size, will rotate at the same revolutions per minute. This is because the sprocket 64 is mounted on the same shaft as sprocket 71 and because the sprocket 63 is mounted on the same shaft as sprocket 68.

The endless track 60, supported by the sprockets 61, 62, 63 and 64, comprises a plurality of pivotally-linked together track members 90. Each track member 90 has a back 91 and side walls 92 and 93 such as defined by a structural channel member, such as one of aluminum (FIGS. 13 to 16). Angle 94 is joined to the outer surface of side wall 92 and angle 95 is similarly joined to the outer surface of side wall 93. The top of the track member 90 is covered by horizontal metal member 96 and the bottom by a similar member 97. The front surfaces of walls 92 and 93, and the front surfaces of the top and bottoms 96 and 97, constitute and provide a rim about cavity 98. Gasket 99 is located around the rim of track member 90 and provides a sealing means when placed in contact with the surface of tank 10.

Figure 13:
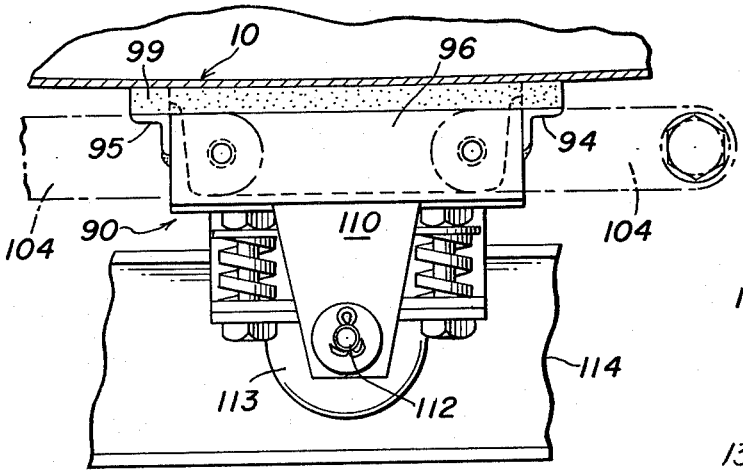
FIG. 13 is a plan view taken along the line 13—13 of FIG. 14, and shows a track member secured to a tank wall.
Figure 14:
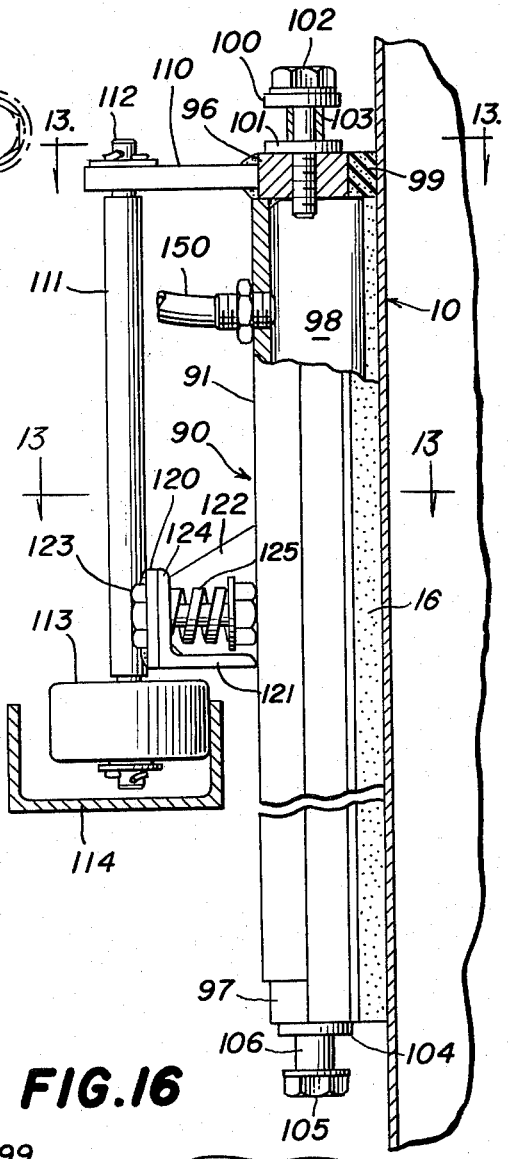
FIG. 14 is a vertical side elevational view, partially in section and partially broken away, showing a track member secured to a tank wall, together with a guide member and a rolling restraining member.
Figure 15:
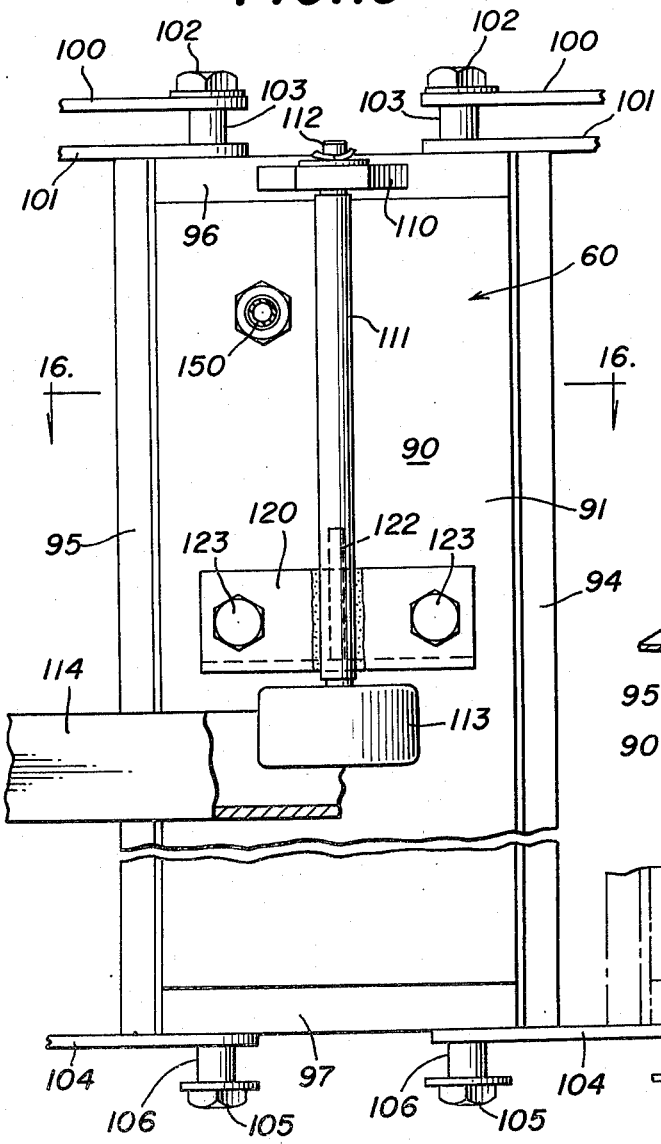
FIG. 15 is a front elevational view, partially in section and partially broken away, of the track member of FIGS. 13 and 14.
Figure 16:
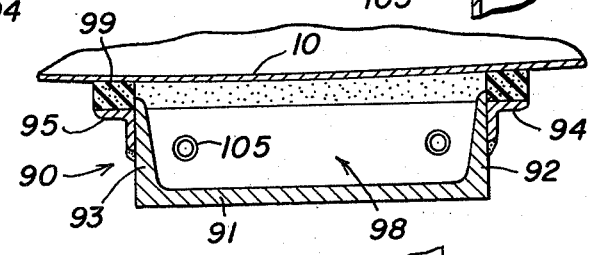
FIG. 16 is a horizontal sectional view taken along the line 16—16 of FIG. 15.

Adjacent track members 90 are joined together by links to make endless track 60. One end of spaced-apart links 100 and 101 are pivotally joined to the top 96 of a track member 90 by a bolt 102 (FIGS. 13 to 15). Collar 103 around bolt 102 keeps the links 100 and 101 spaced apart so there is sufficient clearance between the links to provide space therebetween for the teeth of sprockets 61 and 64. The other end of the links 100 and 101 is pivotally bolted to the adjacent top of an adjoining track member 90. In a similar way the two lower ends of two adjoining track members 90 are pivotally linked together by a link 104 and two bolts 105. Each of the bolts 105 has a collar 106 which engages with the teeth in sprockets 62 and 63 (FIGS. 13 to 15). The collars 103 and 106 are dimensioned and spaced apart to be engaged by the teeth of the sprockets 61 to 64.

Extending rearwardly from the top 96 of each of the track members 90 is a horizontal plate 110 (FIGS. 13 to 15). Rod 111 has a reduced diameter upper end 112 which fits into an oversized hole in plate 110 so that the rod 111, while generally vertically positioned, can move angularly about 15° from the vertical. Roller 113 is mounted on the lower end of rod 111. Channel member 114 constitutes a guide member in which the roller 113, on each of the track members 90, rolls. Vertical members 115 and 116 (FIGS. 5, 7 and 8) extend upwardly from beams 40 and 39 respectively and support guide member 114 on the top.

Vertical plate 120 is welded to the lower end of each of the rods 111. Angle 121 (FIG. 14) is welded to the back 91 of each track member 90 and it is reinforced by vertical flange 122. A pair of bolts 123 extend through two spaced-apart holes in plate 120 and in the vertical flange 124 of angle 121. A compression spring 125 is mounted on each bolt 123 behind flange 124 and forces plate 120 towards the vertical flange 124 (FIGS. 13 to 15). However, since roller 113 is restrained by the channel member 114 the outward or forward movement of track member 90 results in compression of spring 125. Track member 90 thus can move forward into contact with the surface of tank 10 and adjust to irregularities in the tank surface. Furthermore, once each track member 90 is in vacuum contact with the tank surface the holding force developed by evacuation of cavity 98 is transmitted to the supporting rigid framework 30 by means of the channel member 114 because the roller 113 functions as a restraining member against movement of the rigid framework away from the tank wall.

Figure 9:
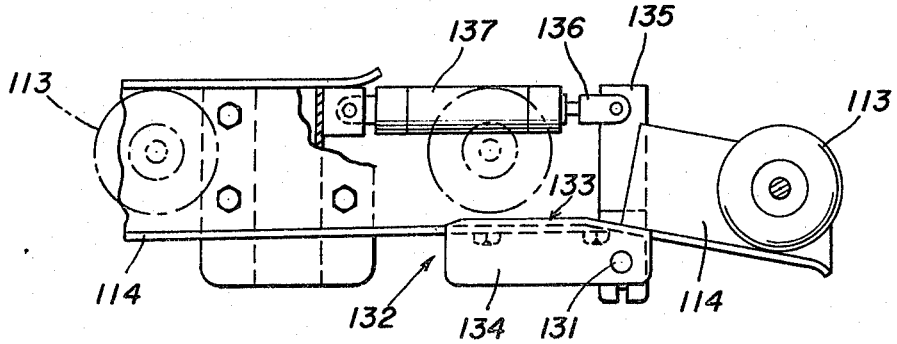
FIG. 9 is a sectional view taken along the line 9—9 of FIG. 8.

With reference to FIGS. 8 and 9, a channel section 130 is joined to the right end of channel member 114. Shaft 131 is mounted in the channel 130 and angle 132, having a vertical flange 133 and a horizontal flange 134, is joined to the shaft 131. Shaft 131 is joined at its lower end to a crank arm 135 joined to piston rod 136 actuated by air cylinder 137. As each of the rollers 113 comes into contact with vertical flange 133 the air cylinder 137 is actuated to cause the piston rod 136 to move laterally to crank arm 135 and thereby cause the vertical flange 133 to rotate outwardly and force the roller 113 outward toward the tank shell 10. This causes the track member 90 to also move forward into pressure contact with the surface of tank 10 before a vacuum is created in the cavity 98. Once the track member 90 has been thereby forced into pressure contact with the tank surface a vacuum is drawn in cavity 98. A vacuum is much more readily obtained in this way since the pressure applied to the track member 90 by means of the pneumatic cylinder 137 provides a better seal between the resilient element 99 and the tank surface particularly when the tank surface is irregular.

The left end of channel member 114 is also provided with a means identical with that shown in FIG. 9 for urging each of the track members 90 into pressure contact with a tank surface before a vacuum is drawn in cavity 98. The result is that the apparatus provided herewith can be operated in either the left of the right direction. Thus, as shown in FIG. 7 a pneumatic cylinder 140 operates piston rod 141 which moves crank arm 142 on shaft 143 which rotates the angle member 144 (like member 132) mounted on shaft 143. When angle member 144 is moved forward it pushes the roller 113 outward and thereby forces the track member 90 into pressure contact with the surface of tank 10 or any other adjacent surface.

Figure 10:
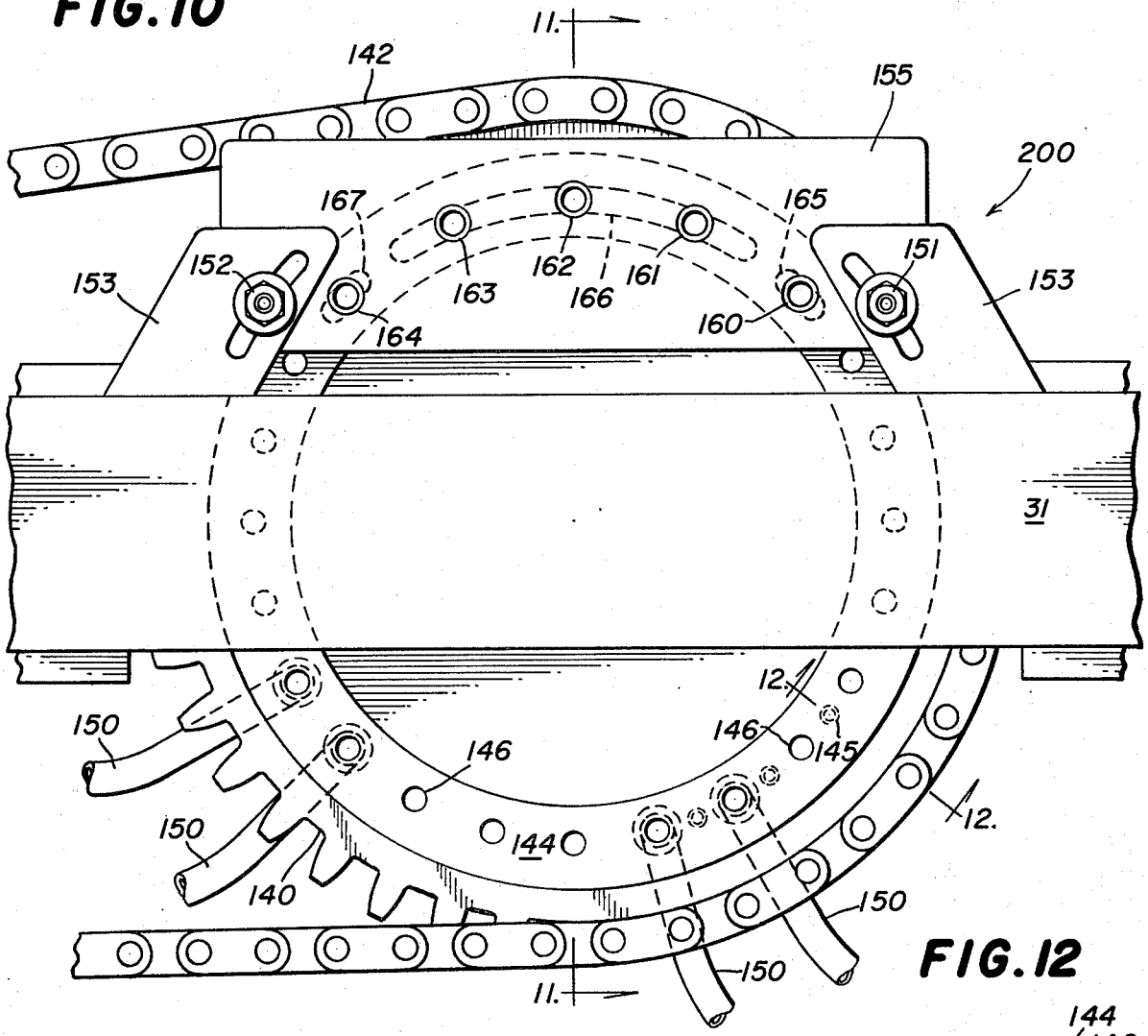
FIG. 10 is an enlarged plan view of the vacuum valve means shown in the central part of FIG. 4.
Figure 12:
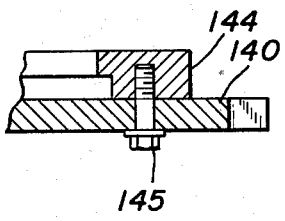
FIG. 12 is a sectional view taken along the line 12—12 of FIG. 10.
Figure 11:
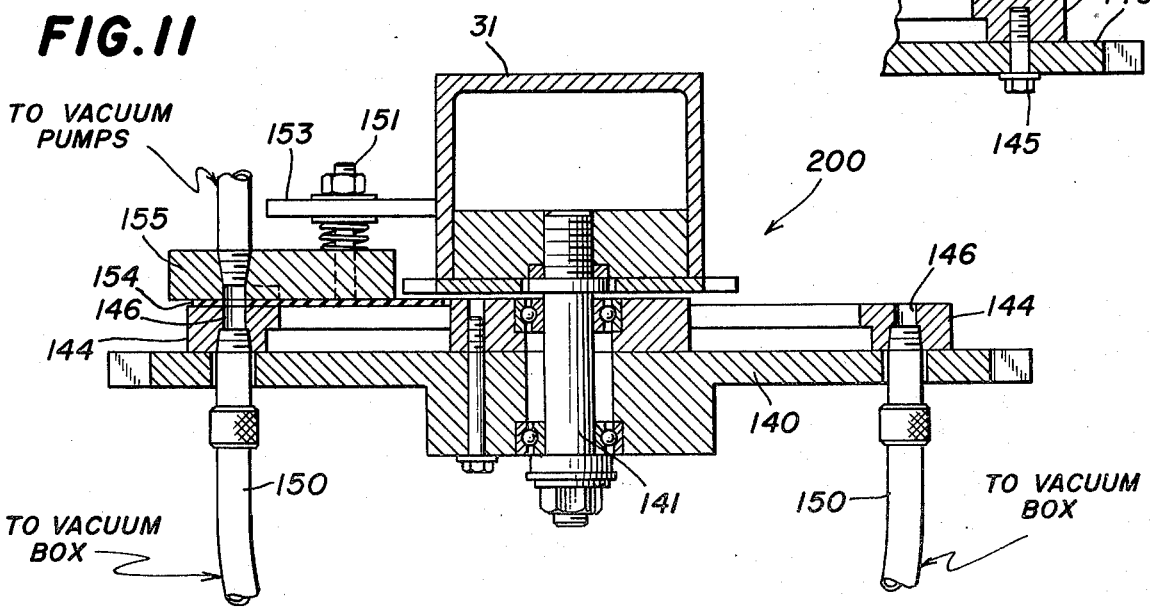
FIG. 11 is a vertical sectional view taken along the line 11—11 of FIG. 10.

Each of the endless track members 90 has a hole in the upper back wall 91 leading into communication with cavity 98. A flexible conduit 150 extends from the hole to a vacuum valving means 200 shown in FIGS. 4, 10 and 11. The vacuum valving means 200 includes a sprocket 140 which is mounted to rotate on shaft 141 secured to the longitudinal channel member 31. Sprocket 140 is driven by chain 142 which goes around sprocket 72. Tension in chain 142 is controlled by idler sprocket 143. Rotating manifold ring 144 is secured by bolts 145 to the top surface of sprocket 140. Ring 144 is provided with a series of holes 146 which are arranged in a circle on the ring 144 with each hole equally spaced from an adjacent hole. Each of the flexible conduits 150 communicates with a hole 146. Thus, the cavity 98 of each of the track members 90 is placed in vacuum communication by a flexible conduit 150 with a hole 146. The number of holes 146 accordingly equals the number of track members 90. Furthermore, the ends of the flexible conduits 150 communicate with the holes 146 in the same consecutive order as the flexible conduits join each of the track members 90 in the endless track 60. Each of the flexible conduits 150 is made sufficiently long so that it will extend from the hole 146 to which it is joined to the track member 90 to which it is also joined, irrespective of the position at any time of the track member 90 with respect to the vacuum valving means 200.

Plate 155 is positioned over a top side portion of manifold ring 144. Plate 155 is secured adjustably by bolts 151 and 152 to plates 153 which are joined to the centrally located beam 31. A flat gasket 154, with vacuum valve grease thereon, is positioned between plate 155 and ring 144.

Plate 155 has holes 160, 161, 162, 163 and 164 positioned in a circular arc which coincides with the circular arrangement of the holes 146 in ring 144. Hole 160 communicates with a small channel 165 in the lower surface of plate 155. Similarly, holes 161, 162, and 163 all communicate with a shallow channel 166 in the lower surface of plate 155. Furthermore, hole 164 communicates with a shallow channel 167 also placed in the lower surface of plate 155. The channels 165 and 167 are of similar length so that the valving means can be used when the vacuum securing apparatus is to travel right or left.

A vacuum line connected to hole 160 creates a vacuum in channel 165. As the pneumatic cylinder 136 urges the vertical flange 133 outward against a roller 113 and thereby causes a track member 90 to move outward into contact with the tank surface, flexible conduit 150 is placed in communication with channel 165 through alignment of a hole 146 therewith. This results in evacuation of the cavity 98 in the track member 90. The vacuum so formed in the cavity 98 results in the track member being firmly secured to the tank wall. As the apparatus moves to the right the track member 90 held by vacuum against the tank wall is held in fixed position. The manifold ring 144, however, rotates and moves the hole 146 from communication with hole 169 into communication with the channel 166 which is evacuated by one or more vacuum lines placed in communication with holes 161 to 163. The channel 166 is arcuately long enough to thereby maintain a vacuum in a series of about four track members 90 placed against a tank surface. As the endless track 60 travels along towards the right on the tank surface the trailing track member 90 is removed from contact with the tank surface. Before the trailing track member 90 is removed from contact with the tank surface, however, the vacuum in its cavity 98 is eliminated by means of a line open to the atmosphere placed in communication with hole 164, Once the vacuum is eliminated, the trailing tracking member 90 is readily removed from contact with the tank surface.

The described valving mechanism can be used in reverse, for travel of the apparatus to the left, by placing a vacuum line in communication with hole 164 and a vacuum release line in communication with hole 160. Of course, a vacuum is not created through hole 164 until the lead track member 90 is put into contact with a tank surface by means of the pneumatic cylinder 140 and flange 144.

The described vacuum valving means thus provides three functions. One function is to pull a vacuum in the cavity of a lead or first track member 90 as it is pushed against a surface. This effectively seats the track member upon the surface as the cavity in that member is placed in communication with a vacuum source. In addition, the vacuum used to evacuate the cavity of the lead track member is independent of the vacuum engaged in maintaining a vacuum in any other cavities in a series of track members already held against a surface, such as of a tank, by means of a vacuum. A second function of the valving means is to maintain an unimpaired vacuum in the cavities of a consecutive series of track members 90 so that a length of the endless track can be maintained securely, such as on a tank surface, by means of a vacuum force. A third function of the valving means is to provide for release of the vacuum in the cavity of the terminal or trailing track member before it is removed from contact with a surface. Release of the vacuum avoids the otherwise necessity of forceably pulling it away.

When a series of track members 90 is placed in vacuum securing contact with a surface, lateral positioning of the rigid framework 30 is achieved and a significant inward resisting force can thereby be applied. Furthermore, this resisting force is maintained continuously whether the apparatus is moving horizontally to the right or to the left.

It is important that the valve sprocket 140 rotate once for each revolution of the endless track 60. Accordingly, the various sprockets employed in the drive mechanism, the sprockets for supporting and rotating the endless track 60 and the sprocket 140 of the valve mechanism must be sized to give the desired coordinated rotation. As shown in FIGS. 5 and 6 the flexible conduits 150, and only representative conduits are shown in the drawings to avoid blocking over other structural features of the apparatus, avoid becoming entangled with themselves and also with other parts of the apparatus because the vertical and horizontal space between the sprockets 61, 62, 63 and 64 is maintained clear of obstructions. The flexible conduits 150 can thus be extended as the endless track 60 crawls along a surface and the sprockets roll along on the temporarily stationary track members 90 held by vacuum to the surface.

Although the described vacuum securing apparatus is firmly held to an inclined or vertical surface by vacuum it should be understood that the weight of the apparatus is generally to be borne by some other support means, such as the cables 11 joined to the top carriage assembly Z or some other supporting means.

The described vacuum securing apparatus X is especially useful as a support for foaming-in-place equipment for insulating tank walls. FIGS. 2, 5 and 6 show the vacuum securing apparatus X supporting a working platform Y of a type which can be used for insulating tank 10. The working platform Y has vertical members 170 and 171 which are joined to the beams 36 and 38. The vertical members 170 and 171 support a floor 172 where an operator can be positioned. A roll 173 of metal sheet 17c is vertically supported on the working platform Y. The metal sheet is passed over guide roll 174 spaced an adjustable predetermined distance from the surface of tank 10. Polyurethane insulating foam is sprayed from nozzle 175 which traverses vertically on reciprocator 176 to deposit a uniform layer of insulating foam 16 between the metal sheet **17*c* and the tank surface. The insulating foam 16 fills the entire space between the sheet 17*c* and the tank surface for the entire height of the metal sheet. The bottom edge 178 of metal sheet 17*c* overlaps the top edge of a similar metal sheet 17*b*.**

After the metal sheet **17*c* clears the roll 174 it passes behind pressure board 179 (FIG. 5) which maintains a pressure against the metal sheet 17c. In this way the expansion and thickness of the polyurethane insulating foam can be carefully controlled. Of course, the pressure exerted by the working platform Y against the metal sheet 17*c* can be regulated by moving the sheaves 13 horizontally either towards the tank surface or outwardly therefrom to vary the turning moment exerted by the weight of the entire apparatus suspended by cables 11. It will be readily seen, of course, that depending on the horizontal position of the sheaves 13 the apparatus supported by cables 11 would tend to pivot or rotate outwardly at the top or bottom from the tank wall in the absence of the gripping or securing action effected on the tank wall by the endless track 60 secured thereto by vacuum. The inward force required to resist the pressure of the expanding or rising insulating foam is obtained by locating the sheaves 13** a sufficient distance inside the composite center of gravity of the apparatus X and the working platform Y to produce a force couple of sufficient magnitude, the outward component of which is accommodated by the vacuum gripping action of the endless track.

The foregoing detailed description has been given for clearness of understanding only, and no unnecessary limitations should be understood therefrom, as modifications will be obvious to those skilled in the art.

What is claimed is:

1. Apparatus to be movably and releasably secured to an inclined or vertical surface comprising:

a rigid framework having two pairs of axially mounted vertically spaced-apart horizontal wheels horizontally spaced-apart on a framework;

an endless track mounted on the wheels and comprising a plurality of pivotally-linked together track members, with each track member having a rim about a cavity adapted to press against said inclined or vertical surface and be secured thereto when a vacuum is created in the cavity;

an open space within the framework and between the vertically spaced-apart wheels;

a flexible vacuum conduit operatively extending from the cavity of each track member into the framework open space and to a vacuum valving means for selectively creating and maintaining a vacuum between the track member and the inclined or vertical surface when in contact therewith; and means operatively associated with the wheels to drive the wheels to thereby effect crawling of the track as it is held by vacuum on the inclined or vertical surface.

2. Apparatus according to claim 1 in which the wheels are sprockets and the endless track has pin-like means which operatively meshes with the sprockets.

3. Apparatus according to claim 1 in which each track member is rectangular, the cavity extends over substantially the rectangular area, and the rim about the cavity has a projecting resilient gasket.

4. Apparatus according to claim 1 in which:

restraining means operatively maintains the framework and the track members in a substantially constant inward-outward relationship but permits restricted outward lateral displacement to accommodate irregularities in an inclined or vertical surface.

5. Apparatus according to claim 1 including:

means operatively suspending the apparatus from an inclined or vertical surface for horizontal movement, said means being capable of bearing at least essentially all of the weight of the apparatus.

6. Apparatus according to claim 5 in which the means for suspending the apparatus includes adjustable means operatively varying the effective center of gravity of the apparatus relative to an upwardly extending surface to thereby tilt it in or out.

7. Apparatus according to claim 1 including:

an equipment support stand connected to the framework above or below the endless track.

8. Apparatus according to claim 7 in which the equipment support stand contains means to deposit polymeric insulating foam on an upwardly extending surface and contains a roll of sheet metal to be unrolled and applied on the foam as the foam is deposited.

9. Apparatus to be movably and releasably secured to an inclined or vertical surface comprising:

a rigid framework having two pairs of axially mounted vertically spaced-apart horizontal sprockets horizontally spaced-apart on a framework;

an endless track mounted on the sprockets and comprising a plurality of pivotally-linked together track members, with each track member having a rim about a cavity therein adapted to press against said inclined or vertical surface and be secured thereto when a vacuum is created in the cavity;

an open space within the framework and between the vertically spaced-apart sprockets;

a flexible vacuum conduit operatively extending from the cavity of each track member into the framework open space and to a vacuum valving means for selectively creating and maintaining a vacuum between the track member and an inclined or vertical surface when in contact therewith;

the vacuum valve means including a rotatable horizontal plate with ports to which the flexible vacuum conduits are joined, means operatively associated with the plate to rotate the plate one revolution per revolution of the track, and means operatively and selectively draw a vacuum through one or more of said ports to thereby create a vacuum between the track members and an inclined or vertical surface by means of the vacuum conduits communicating with the ports;

means operatively mounted on the framework to push each consecutive concave member, as it comes into position by crawling of the track facing approximately parallel to an upwardly extending surface, laterally outwardly into contact with the surface as a vacuum is created in the cavity of the concave member; and means operatively associated with the sprockets to drive the sprockets to thereby effect crawling of the track as it is held by vacuum on the inclined or vertical surface.

10. Apparatus according to claim 9 in which the vacuum valving means is operatively adapted to maintain a vacuum at consecutive track members when in contact with an inclined or vertical surface.

11. Apparatus according to claim 9 in which each track member is rectangular, the cavity extends over substantially the rectangular area, and the rim about the cavity has a projecting resilient gasket.

12. Apparatus according to claim 9 in which:

restraining means operatively maintains the framework and the track members in a substantially constant inward-outward relationship but permits restricted outward displacement to accommodate irregularities in an inclined or vertical surface.

13. Apparatus to be movably and releasably secured to an inclined or vertical surface comprising:

a rigid framework having two pairs of axially mounted vertically spaced-apart horizontal wheels horizontally spaced-apart on a framework;

an endless track mounted on the wheels and comprising a plurality of pivotally-linked together track members, with each track member having a rim about a cavity adapted to press against said inclined or vertical surface and be securd thereto when a vacuum is created in the cavity;

an open space within the framework and between the vertically spaced-apart wheels;

a flexible vacuum conduit operatively extending from the cavity of each track member into the framework open space and to a vacuum valving means for selectively creating and maintaining a vacuum between the track member and the inclined or vertical surface when in contact therewith; and means operatively associated with the wheels to drive the wheels to thereby effect crawling of the track as it is held by vacuum on the inclined or vertical surface;

the vacuum valving means including a rotatable horizontal plate with ports to which the flexible vacuum conduits are joined, means operatively associated with the plate to rotate the plate one revolution per revolution of the track, and means to operatively and selectively drawing a vacuum through one or more of said ports to thereby create a vacuum between the track members and an inclined or vertical surface by means of the vacuum conduits communicating with the ports.

14. Apparatus according to claim 13 in which the vacuum valving means is operatively adapted to simultaneously maintain a vacuum between consecutive track members and an inclined or vertical surface when in contact therewith.

15. Apparatus according to claim 13 in which the means to selectively draw a vacuum through one or more of said ports comprises:

a stationary means having three arcuately aligned separate grooves which operatively register with a consecutive number of the ports in the rotating plate;

one of the grooves of the stationary means providing means to operatively draw a vacuum in the cavity of a track member as it contacts an inclined or vertical surface;

a second groove in the stationary means providing means to operatively maintain a vacuum at a consecutive number of cavities of the track members when in contact with an inclined or vertical surface; and a third groove in the stationary means providing means to operatively vent the vacuum of a track member before it moves out of contact with an inclined or vertical surface by rotation of the track.

16. Apparatus to be movably and releasably secured to an inclined or vertical surface comprising:

a rigid framework having two pairs of axially mounted vertically spaced-apart horizontal wheels horizontally spaced-apart on a framework;

an endless track mounted on the wheels and comprising a plurality of pivotally-linked together track members, with each track member having a rim about a cavity adapted to press against said inclined or vertical surface and be secured thereto when a vacuum is created in the cavity;

an open space within the framework and between the vertically spaced-apart wheels;

a flexible vacuum conduit extending operatively from the cavity of each track member into the framework open space and to a vacuum valving means for selectively creating and maintaining a vacuum between the track member and the inclined or vertical surface when in contact therewith;

means operatively associated with the wheels to drive the wheels to thereby effect crawling of the track as it is held by vacuum on the inclined or vertical surface; and a means operatively mounted on the framework to push each consecutive track member, as it comes into position by crawling of the track facing approximately parallel to an inclined or vertical surface, laterally outwardly into contact with the surface as a vacuum is created in the cavity of the track member.

17. Apparatus to be movably and releasably secured to an inclined or vertical surface comprising:

a rigid framework having two pairs of axially mounted vertically spaced-apart horizontal wheels horizontally spaced-apart on a framework;

an endless track mounted on the wheels and comprising a plurality of pivotally-linked together track members, with each track member having a rim about a cavity adapted to press against said inclined or vertical surface and be secured thereto when a vacuum is created in the cavity;

an open space within the framework and between the vertically spaced-apart wheels;

a restraining means which operatively maintains the framework and the track members in a substantially constant inware-outward relationship but permits restricted outward lateral displacement to accommodate irregularities in an inclined or vertical surface;

the restraining means comprising a horizontal guide rail supported by the framework in the open space in back of the endless track;

each track member having a restraining member in back of, and connected to, it and movable along the guide rail;

a flexible vacuum conduit extending from the cavity of each track member into the framework open space and to a vacuum valving means operatively and selectively creating and maintaining a vacuum between the track member and the inclined or vertical surface when in contact therewith; and means operatively associated with the wheels to drive the wheels to thereby effect crawling of the track as it is held by vacuum on the inclined or vertical surface.

18. Apparatus according to claim 17, in which:

the restraining member is resiliently joined to the track member.

19. Apparatus according to claim 18 in which:

the guide rail is a channel;

the restraining member comprises a roller on the lower end of a vertical axle which is pivotally joined to a support on the upper part of the track member;

the roller riding in the guide rail channel; and resilient means operatively securing a lower portion of the axle to the back of the track member so that limited outward displacement of the track member can be effected relative to the guide rail.

* * * * *

UNITED STATES PATENT AND TRADEMARK OFFICE

CERTIFICATE OF CORRECTION

PATENT NO. : 3,991,842

DATED : November 16, 1976

INVENTOR(S) : Lyle V. Larsen

It is certified that error appears in the above-identified patent and that said Letters Patent are hereby corrected as shown below:

Abstract, line 6, after "each" insert --track--; column 5, line 31, after "18" insert --is--; column 6, line 4, delete the comma (,) after "54"; column 8, line 26, change "of" to --or--; column 9, line 27, change "169" to --160--; column 12, line 27, change "draw" to --drawing-- and in line 67, change "securd" to --secured--; column 13, line 17, change "means to" to --means--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*